United States Patent [19]

Brown et al.

[11] 4,347,647

[45] Sep. 7, 1982

[54] APPARATUS FOR MAKING NO-TWIST YARN

[75] Inventors: Roger S. Brown, Clemson, S.C.; Harold L. Salaun, Jr.; Gain L. Louis, both of Metairie, La.

[73] Assignee: The United States of America as represented by the Secretary of Agriculture, Washington, D.C.

[21] Appl. No.: 202,397

[22] Filed: Oct. 30, 1980

[51] Int. Cl.[3] ..... D01G 19/10

[52] U.S. Cl. ..... 19/128; 19/112; 19/236; 19/258

[58] Field of Search ..... 19/112, 115 R, 215, 19/128, 236, 258, 294

[56] References Cited

U.S. PATENT DOCUMENTS

| | | | |
|---|---|---|---|
| 1,862,542 | 6/1932 | Laurency | 19/112 X |
| 2,014,673 | 9/1935 | Setzer | 19/112 X |
| 3,066,357 | 12/1962 | Kingsbury | 19/236 X |
| 3,988,807 | 11/1976 | Ueda et al. | 19/128 X |
| 4,014,076 | 3/1977 | Slanik | 19/236 X |

FOREIGN PATENT DOCUMENTS

| | | | |
|---|---|---|---|
| 16944 | of 1887 | United Kingdom | 19/128 |
| 324802 | 2/1930 | United Kingdom | 19/128 |

OTHER PUBLICATIONS

Textile Topics, a bulletin published by Textile Research Center, Lubbock, TX vol. III, No. 1, Sep. 1979.

Twistless Yarn–A New Method For The Manufacture Of Modern Textile Fabrics by T.H.M. Terwee, appearing in Chemielfasern/Textilindustrie, vol. 29/81 (1979)E108–E110.

*Primary Examiner*—Louis Rimrodt

*Attorney, Agent, or Firm*—M. Howard Silverstein; David G. McConnell; Raymond C. VonBodungen

[57] ABSTRACT

An apparatus for drafting and parallelizing strands of fiber comprising three side-by-side rolls nested in three side-by-side troughs which conform to and are adjacent the bottoms of the three rolls. The rolls are rotated in the same direction at sequentially greater speeds. The first two rolls include fiber-combing teeth, and the third roll is composed of a smooth, rubber-like surface. The fibers pass sequentially around the bottoms of the three rolls through a very narrow gap between the rolls and troughs to emerge in a parallelized, drafted condition. The unit may be incorporated into a no-twist yarn system as the sole mechanism for drafting and parallelizing the fiber, to form no-twist yarn in a continuous manner; or be used in place of conventional drafting system.

10 Claims, 3 Drawing Figures

APPARATUS FOR MAKING NO-TWIST YARN

BACKGROUND OF THE INVENTION (1) Field of the Invention

This invention relates to apparatus for drafting and parallelizing fibers for no-twist or ordinary (twisted) textile yarn.

(2) Description of the Prior Art

It is well known to those familiar with textile processing that the need to straighten and parallelize staple fibers is a most difficult and essential step in the yarn-forming process. Furthermore, it is well known that drafting or drawing is the most common method for obtaining this parallelization. Conventionally, parallelization is accomplished by a plurality of pairs of drawing rolls in series between which the fibers pass with progressively increasing speeds of rotation for the successive pairs of rolls. Each pair of rolls has a relatively firm grip on the fibers and in order to accomplish the draft, it is necessary for the several pairs of rolls to be spaced apart a distance at least slightly greater than the length of the longest fibers. This results in an uneven drawing because the fibers are always drawn at the weakest point, and in spite of careful attention to operation, uneven places in the yarn can be detected. These uneven places are commonly referred to as drafting waves. In practice various methods are used to reduce or control drafting waves, the most common of which is the use of aprons to control the fibers in the main drafting zone. Doubling or simultaneously drafting a plurality of slivers and combining them into a single sliver thus averaging the thick and thin places is another method for reducing the effect of drafting waves.

In addition to the costs associated with these efforts to produce a uniform sliver, the discontinuity caused by the need for doubling makes the yarn-forming process extremely difficult to completely automate.

Fiber drafting and parallelization is particularly important in the production of no-twist (twistless) yarn. Generally, such yarn is made by drafting and parallelizing strands of fiber, applying a temporary adhesive (liquid binder) to the fibers, drying the binder and winding the thus-produced yarn. Thereafter, the yarn is formed into a fabric by, for example, weaving, afterwhich the binder is water-washed from the fiber. Problems associated with twistless yarn are discussed in (1) "Textile Topics", a bulletin published by the Textile Research Center of Lubbock, Tex., Vol. III, No. 1, September 1979; and (2) "Twistless Yarn—A New Method For The Manufacture Of Modern Textile Fabrics" by T. H. M. Terwee, appearing in *Chemielfasern-/Textilindustre,* Vol 29/81 (1979), E108–E110. To date, a continuous process for the production of the twistless yarn directly from card web has not been developed.

SUMMARY OF THE INVENTION

We have now developed a novel drafting and parallelizing apparatus comprising:

a. a first roll having fiber-combing teeth on its surface;

b. a second roll having fiber-combing teeth on its surface, the second roll being parallel and adjacent to the first roll to define a pocket therebetween;

c. a third roll having a resilient surface, the third roll being parallel and adjacent the second roll to define a pocket therebetween;

d. means to rotate the three rolls in the same direction at sequentially greater speeds;

e. a curved surface conforming to the surfaces of the three rolls, the curved surface including a first apex-shaped segment which extends into the pocket between the first two rolls to conform the curved surface to the surfaces of the two rolls in the pocket; the curved surface further including a second apex-shaped segment which extends into the pocket between the second and third rolls to conform the curved surface to the surfaces of the second and third rolls in the pocket therebetween; wherein the curved surface is closely adjacent but does not touch the first and second rolls; wherein the curved surface touches the third roll at the second apex-shaped segment; wherein the fiber-combing teeth of the first roll carry the fibers between the first roll and the adjacent curved surface to the first apex-shaped segment, afterwhich the fibers are picked up by the fiber-combing teeth on the second roll and carried between the second roll and adjacent curved surface to the second apex-shaped segment, afterwhich the third roll, in combination with the second apex-shaped segment, grips the fibers and removes the fibers from the second roll to carry the fibers between the third roll and adjacent curved surface.

The fibers emerge from the third roll in a drafted and parallelized state.

The device is particularly effective in providing a continuous no-twist yarn production system. In such a system, an uncondensed strip of card web is fed onto the first roll to emerge in a drafted and a parallelized condition from the third roll, afterwhich the fibers pass through a binding liquid applicator, then to a binding liquid drier, and subsequently to a yarn winder, wherein the above-described three rolls provide the only means for drafting and parallelization of the strip of card web.

It is therefore an object of the present invention to provide a space-saving apparatus for accomplishing drafting and parallelization of textile fiber.

Another object is to provide a continuous no-twist yarn production system which obviates the need of the prior art drawing, roving and spinning steps and machinery.

A further object is to eliminate the drafting wave problem associated with prior art drafting devices.

Still another object is to eliminate the need for doubling or simultaneously drafting a plurality of slivers and combining them into a single sliver.

An additional object is to convert a strip of standard card fibrous web into a fine fibrous strand of parallelized fibers, which may be subsequently formed into no-twist yarn.

Still another object is to maintain positive control over the fibers as they pass through a drafting device, to thereby eliminate drafting waves.

Yet another object is to substantially reduce steps and time in the production of textile yarns.

Still a further object is to provide a single-pass operation for the production of textile yarn directly from card web.

DESCRIPTION OF THE PREFERRED EMBODIMENTS

Figure 1:
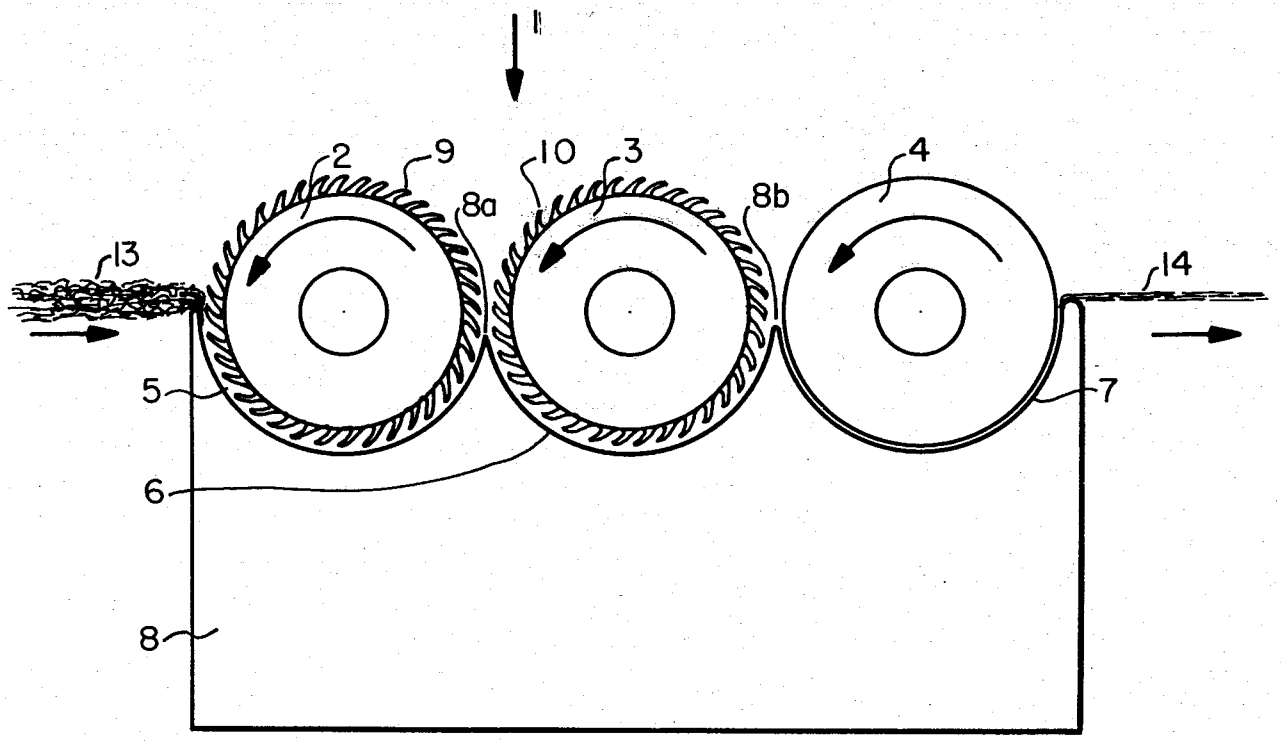
FIG. 1 is a side view of the fiber drafting and parallelizing apparatus of the present invention.

Referring to FIG. 1, reference numeral 1 designates the fiber parallelizing and drafting device of the instant invention. It comprises rolls 2, 3 and 4 nested in three semi-cylindrical troughs 5, 6, and 7, respectively. These troughs are defined by the upper, curved, smooth (e.g., polished metal) surface of machined block 8, which surface includes apex-shaped segments 8*a* and 8*b* that extend into the pockets defined by adjacent surfaces of rolls 2 and 3, and rolls 3 and 4, respectively, so that the upper surface of the block closely conforms or contours to the lower half of the surfaces of the rolls.

Covering the surfaces of rolls 2 and 3 are conventional fiber-combining teeth 9 and 10, respectively. These type of teeth are well known in the yarn manufacturing art wherein they are most often found on the main carding cylinder. Usually they are formed by spirally wrapping toothed wire around the cylinder or roll.

Preferably, the teeth have a negative rake so as to facilitate parallelizing and fiber transport action described in more detail hereinafter. The rake angle generally ranges from about 0° to 20°, preferably, about 10°.

The surfaces of trough 5 and 6 are set as close as possible to the outer tips of teeth 9 and 10 without touching same. Preferably, this distance is about 0.001–0.003 inch. This same dimension also is suitable with regard to the distance from the tips of teeth 9 to the tips of teeth 10 at the point of closest proximity between rolls 2 and 3. The same is true of the distance from the tips of teeth 10 to the surface of roll 4 at the point of closest proximity between 3 and 4.

Roll 4, preferably made from a resilient material such as rubber, is in intimate contact with the surface of trough 7 at apex-shaped segment 8*b* to form a fiber-gripping zone. Thereafter, a narrow gap is formed between roll 4 and trough 7, which gap gradually widens. The average gap dimension is about 0.005–0.007 inch. Generally, roll 4 has a hardness of about 60 to 70-shore, preferably, about 65-shore.

Rolls 2, 3 and 4 are rotated in the same direction at sequentially greater surface speeds progressing from roll 2 to roll 4. This enables the apparatus to accomplish the necessary drawing effect, which is an integral part of parallelization. Exemplary surface speed ratios between rolls 2 and 3 range from about 1:1 to 1:4, preferably about 1:2. Exemplary surface speed ratios between rolls 3 and 4 range from about 1:2 to 1:8, preferably about 1:6.

Figure 2:
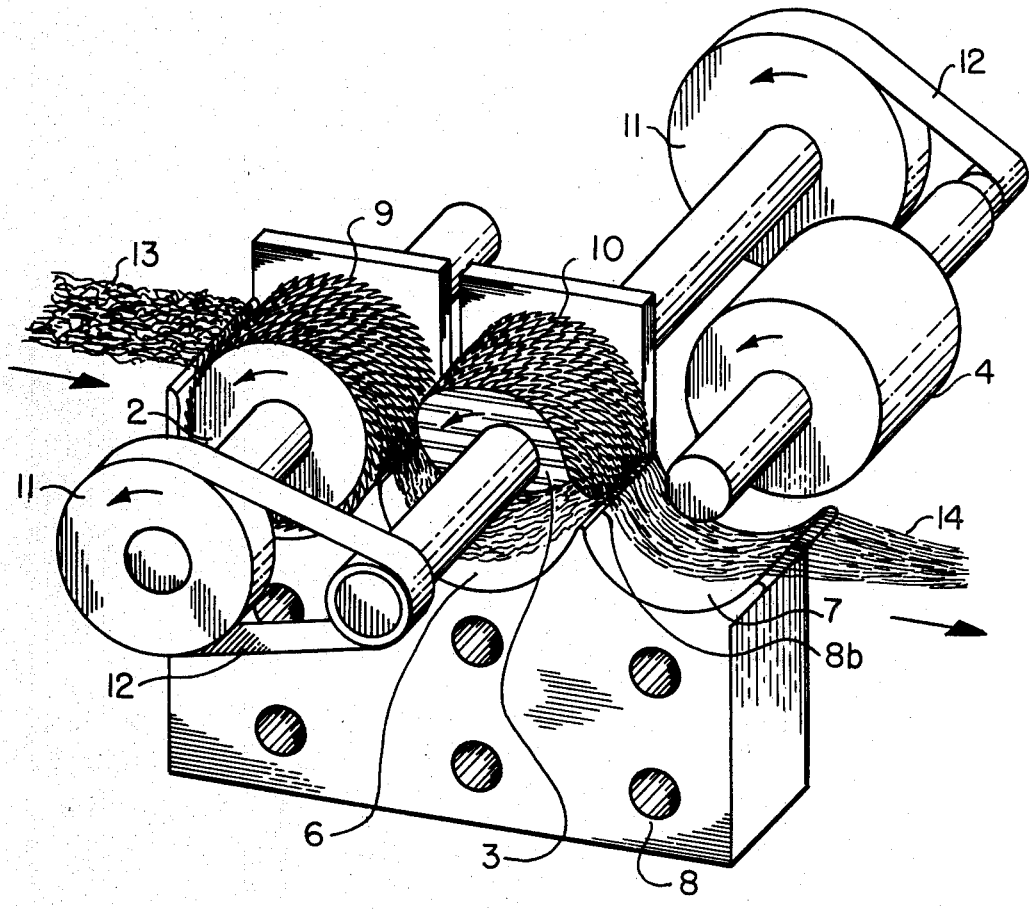
FIG. 2 is a perspective, partially exploded view of the roll rotating means of FIG. 1.

The types of machinery to produce the differential roll speeds will be obvious to those skilled in the art. FIG. 2 illustrates an exemplary mechanism which includes gears or pulleys 11 and chains or belts 12 attached to a motor (not shown).

As a general rule, rolls 2, 3 and 4 may be the same diamater as one another, ranging in size from about 1 to 3 inches, depending upon such factors as available space and the type of fiber being processed.

Referring again to FIG. 1, in the operation of unit 1, a card web of unoriented fibers 13 is fed to roll 2 to be carried downward by teeth 9 through the very narrow gap between trough 5 and roll 2. During such movement the fibers are lightly pressed against the surface of trough 5. As the fibers travel past apex-shaped segment 8*a*, their leading ends are contacted by teeth 10 of roll 3 and are straightened as teeth 10 pass through them. The trailing ends of the fibers prefer to remain held by teeth 9 of roll 2, which teeth are inclined in a more favorable direction than teeth 10 for holding action. However, the pulling action of roll 3 ultimately overcomes the holding action of teeth 9. As that portion of the trailing end of an individual fiber engaged by teeth 9 becomes less, teeth 10 pull the fiber free from teeth 9 and urge the fiber toward apex-shaped segment 8*b*. As the fibers pass between roll 3 and trough 6, they are lightly pressed against the trough surface.

As the fibers are propelled forward by roll 3 toward segment 8*b*, they are drawn out due to the fact that roll 3 is traveling at a greater speed than roll 2. When the leading ends of the fibers emerge past the tip of segment 8*b*, they are contacted by the surface of roll 4 which immediately pinches the fibers in the gripping zone between roll 4 and segment 8*b*, afterwhich the fibers are accelerated to the faster moving surface speed of roll 4 and further drawn out as they are urged to slide on the smooth surface of trough 7 by the moving surface of roll 4. The trailing ends of such fibers, being interwined with teeth 10 of roll 3 are pulled through such teeth and thus straightened. The fibers continue around roll 4, lightly pressed against the surface of trough 7 to emerge past block 8 as a strand of aligned and drawn out fibers 14.

The interaction between rolls 2 and 3, and between rolls 3 and 4, maintains positive control over the fibers at all times during the drafting and parallelization process, thus eliminating drafting waves.

Figure 3:
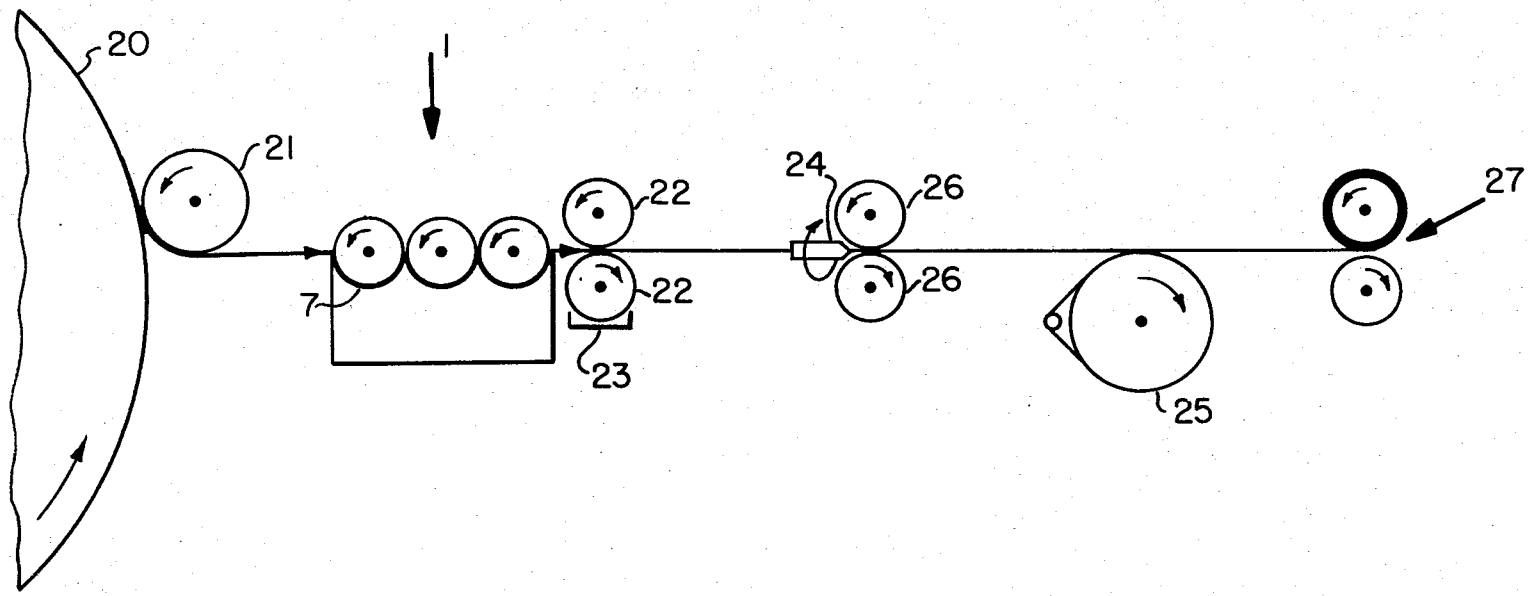
FIG. 3 is a schematic view of the apparatus of FIG. 1 in a no-twist yarn production system.

Referring now to FIG. 3, therein is shown a system for the production of no-twist yarn, employing the above-described parallelizing apparatus. Reference numeral 20 designates a conventional card cylinder. Doffing roll 21 removes a narrow band of card web (e.g., about 1 to 3 inches) from the cylinder and directs same toward unit 1 of the instant invention. It is not necesary for the strands to pass through a condensing device such as a trumpet prior to sending same to unit 1.

The fibers emerge from unit 1 in a final state of a parallelization and drafting. At this point the strip is narrowed (condensed) by a trumpet (not shown), after which the strands enter a liquid applicator consisting of squeeze rolls 22 and liquid trough 23, in which unit the strands are impregnated with a liquid binder. These liquids, which are well known in the art of no-twist yarn production, must be of such a nature that they can be readily removed by water after the fiber has been woven or otherwise formed into fabric. Typical liquid binders include polyvinyl alcohol, sodium carboxymethylcellulose, and polyacrylic acid in aqueous concentrations of about 5% to 30%.

From the liquid applicator, the strand passes through a false-twister 24, to give the strand temporary strength prior to the drying of the binder at drum drier 25. A set of rolls 26 pull the continuous strand of fibers through the false-twister 24 toward the drum drier 25 and yarn winder 27.

After winding, the yarn can be formed into fabric in the same manner that ordinary (twisted) yarn would be. In comparison to prior art no-twist yarn production techniques, the above-described system provides continuous processing, and produces as much as 150 yards per minute.

As a modification to the system of FIG. 3, doffing roll 21 may be taped to form a plurality of rings on the working surface of the doffer, in the manner previously used in the art of manufacturing twisted wool yarn. As a result, a plurality of narrow webs of the requisite width may be picked off the wide web on card cylinder 20, and each narrow web can then be sent directly to one of a plurality of systems as that described in FIG. 3. As a further modification to such a plural system, each of the fiber drafting and parallelizing units can be mounted on common shafts, common frames, and energized by a single means, thus compacting the plural system.

The fibrous material that can be processed by the apparatus of the present invention includes cotton, wool, as well as stapled manmade-fiber, and blends of textile fibers.

We claim:

1. Fiber drafting and parallelizing apparatus comprising:

a. a first roll having fiber-combing teeth on its surface;

b. a second roll having fiber-combing teeth on its surface, said second roll being parallel and adjacent to said first roll to define a pocket therebetween;

c. a third roll having a resilient surface, said third roll being parallel and adjacent to said second roll to define a pocket therebetween;

d. means to rotate said first, second and third rolls in the same direction at sequentially greater surface speeds;

e. a curved surface conforming to the surfaces of said first, second and third rolls, said curved surface including a first apex-shaped segment which extends into said pocket between said first and second rolls so as to conform said curved surface to said first and second rolls in said pocket therebetween; said curved surface further including a second apex-shaped segment which extends into said pocket between said second and third rolls so as to conform said curved surface to said second and third rolls in said pocket therebetween; wherein said curved surface is closely adjacent but does not touch said first and second rolls; wherein said curved surface touches said third roll at said second apex-shaped segment; and wherein said fiber-combing teeth of said first roll carry fibers between said first roll and said closely adjacent curved surface to said first apex-shaped segment, afterwhich said fibers are picked up by said fiber-combing teeth on said second roll and carried between said second roll and said closely adjacent curved surface to said second apex-shaped segment, afterwhich said third roll, in combination with said second apex-shaped segment, grips said fibers and removes said fibers from said second roll to carry said fibers between said third roll and said closely adjacent curved surface, so that said fibers emerge from said third roll in a parallelized and drafted condition.

2. The apparatus of claim 1 including fiber feeding means upstream from said first roll to feed previously carded fiber onto said first roll.

3. The apparatus of claim 1 wherein said first, second and third rolls are horizontally disposed, side-by-side; wherein said curved surface is disposed below said rolls in the form of first, second and third semi-cylindrically shaped, side-by-side, troughs in which said first, second and third rolls are respectively nested.

4. The apparatus of claim 3 wherein the surface speed ratio between said first and second rolls is about 1:1 to 1:4, and wherein the surface speed ratio between said second and third rolls is about 1:2 to 1:8; and wherein said fiber-combing teeth on said first and second rolls have a negative rake.

5. The apparatus of claim 1 wherein the surface speed ratio between said first and second rolls is about 1:1 to 1:4, and wherein the surface speed ratio between said second and third rolls is about 1:2 and 1:8.

6. The apparatus of claim 1 wherein said fiber-combing teeth on said first and second rolls have a negative rake.

7. The apparatus of claim 1 further including fiber feeding means upstream from said first roll to feed an uncondensed strip of card web onto said fiber-combing teeth of said first roll; binding liquid applicator means downstream from said third roll to temporarily bind fiber strands which emerge from said third roll; liquid drying means downstream from said applicator means to dry said binder on said strands; winding means downstream from said drying means to wind said strands; wherein said first, second and third rolls provide the only means for drafting and parallelization of said strip of card web.

8. The apparatus of claim 7 wherein said first, second and third rolls are horizontally disposed, side-by-side; wherein said curved surface is disposed below said rolls in the form of first, second and third semi-cylindrically shaped, side-by-side troughs in which said first, second and third rolls are respectively nested.

9. The apparatus of claim 8 wherein the surface speed ratio between said first and second rolls is about 1:1 to 1:4; and wherein the surface speed ratio between the second and third rolls is about 1:2 to 1:8.

10. The apparatus of claim 9 wherein said fiber-combing teeth on said first and second rolls have a negative rake.

* * * * *